US006684429B1

(12) United States Patent
Deering

(10) Patent No.: US 6,684,429 B1
(45) Date of Patent: Feb. 3, 2004

(54) BEACH PILLOW

(76) Inventor: William Deering, 110 McBride Rd., Litchfield, CT (US) 06759

( * ) Notice: Subject to any disclaimer, the term of this patent is extended or adjusted under 35 U.S.C. 154(b) by 0 days.

(21) Appl. No.: 10/329,020

(22) Filed: Dec. 24, 2002

Related U.S. Application Data

(60) Provisional application No. 60/408,464, filed on Sep. 6, 2002.

(51) Int. Cl.[7] ..... A47C 20/00

(52) U.S. Cl. ..... 5/644; 5/636; 5/655.3; 5/655.5

(58) Field of Search ..... 5/652, 654, 655.3, 5/655.5, 656, 644, 636, 639, 645

(56) References Cited

U.S. PATENT DOCUMENTS 2,682,918 A * 7/1954 Porter ..... 267/117
4,247,963 A * 2/1981 Reddi ..... 5/687
4,724,560 A * 2/1988 Christie ..... 5/644
4,815,154 A * 3/1989 Grimes ..... 5/657
4,896,388 A * 1/1990 Bard ..... 5/644
6,217,116 B1 * 4/2001 Sloot ..... 297/397
6,233,767 B1 * 5/2001 Horowitz ..... 5/644

* cited by examiner

*Primary Examiner*—Teri Pham Luu
(74) *Attorney, Agent, or Firm*—McCormick, Paulding & Huber LLP

(57) ABSTRACT

An inflatable beach pillow is provided with a water compartment that can be filled to anchor the pillow in place, and also has a sand pocket that can alternatively be filled with sand to serve as a weighting material. The sand pocket will slip over the back of a chair to allow the inflatable pillow to serve as a headrest.

7 Claims, 3 Drawing Sheets

BEACH PILLOW

CROSS REFERENCE TO RELATED APPLICATIONS

This application claims the benefits of prior filed, co-pending provisional application Ser. No. 60/408,464 filed Sep. 6, 2002.

BACKGROUND OF THE INVENTION

This invention relates to a beach pillow. More specifically, this invention relates to an inflatable beach pillow having compartments for sand and water, useful to weigh down the pillow so that it will not blow away in the wind.

An inflatable beach pillow having a pocket adapted to be filled with sand and having straps to attach it to a chair is shown in U.S. Pat. No. 4,815,154 issued Mar. 28, 1989 to Grimes. The Grimes patent uses sand as a weighting material and therefore would be of limited use at a swimming pool where there is no sand.

U.S. Pat. No. 4,928,336 issued May 29, 1990 to Petillo also shows an inflatable headrest with a zippered compartment for receiving weighting material such as wallets, keys, suntan lotion, and in some cases, sand.

U.S. Pat. No. 6,217,116 issued Apr. 17, 2001 to Sloot discloses an inflatable pillow attached to a pocket shaped slipcover designed to fit over the back of a chair, but having no means to use it as a weighted beach pillow.

One object of the present invention is to provide a beach pillow which serves as a weighted inflatable pillow, which may be used either on the beach or in environments such as a pool where sand or similar weighting material is not available.

Another object of the invention is to provide an inflatable pillow, which may either be used as a weighted pillow or as a head rest on the back of a chair.

Another object is to provide an inflatable beach pillow which satisfies multiple needs and is economical to produce.

BRIEF DESCRIPTION OF THE DRAWINGS

Additional objects and features of the invention will be clear to those skilled in the art upon examining the following specification and drawings, wherein.

SUMMARY OF THE INVENTION

Briefly stated, the invention comprises an inflatable weightable beach pillow comprising a generally rectangular flexible base sheet arranged to be folded about a fold line extending between its side edges, a first flexible sheet section sealed about its periphery to the base sheet on one side of the fold line to define an inflatable air compartment for providing a pillow, a second flexible sheet section sealed about its periphery to the base sheet on the other side of the fold line to provide a fillable water compartment for weighting the beach pillow, an air valve communicating with the air compartment for inflating and deflating it, and a closure valve communicating with the water compartment for filling and draining it. When the base sheet is folded and either permanently or temporarily connected along the side edges, it forms a pocket for receiving weighting material, such as sand. Alternatively, the pocket may be slipped over the back of a chair and used to retain the inflatable pillow on the chair back.

DESCRIPTION OF THE PREFERRED EMBODIMENTS

Figure 1:
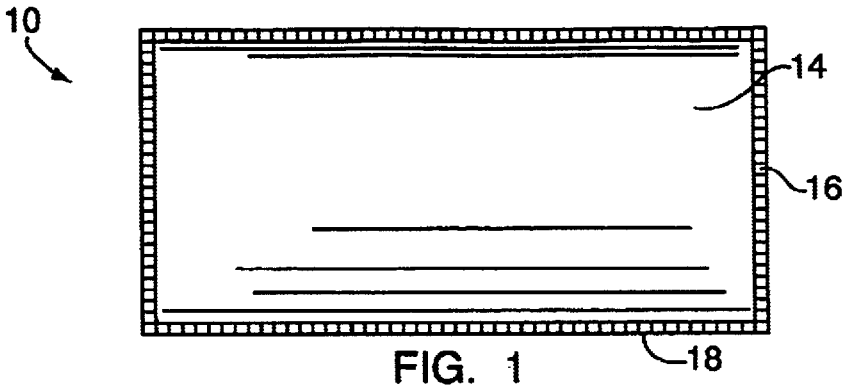
FIG. 1 is a top plan view of a beach pillow embodying the invention.
Figure 2:
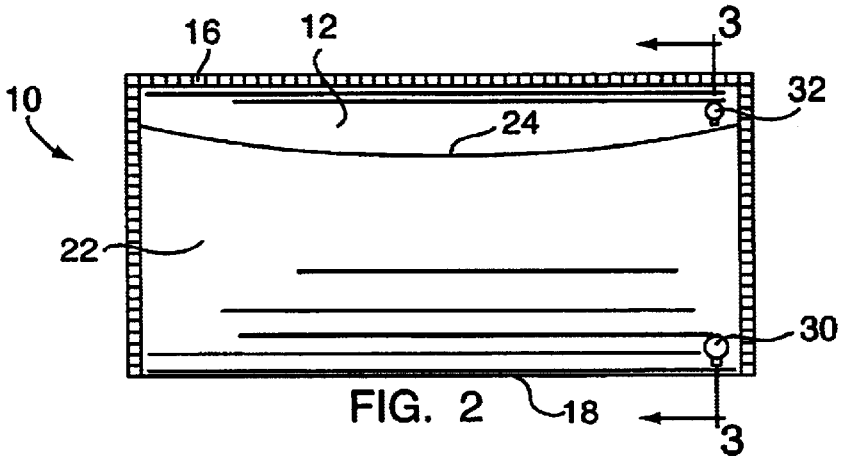
FIG. 2 is a bottom plan view.

A beach pillow embodying the invention is shown in FIG. 1 and generally designated 10. It comprises a base sheet 12 of plastic on which a similar sized pocket sheet 14 of plastic is superposed. An air confining sheet section 15 of pocket sheet 14 is heat sealed as at 16 to the base sheet 12 around the margins to form air inflatable air compartment 17.

Figure 3:
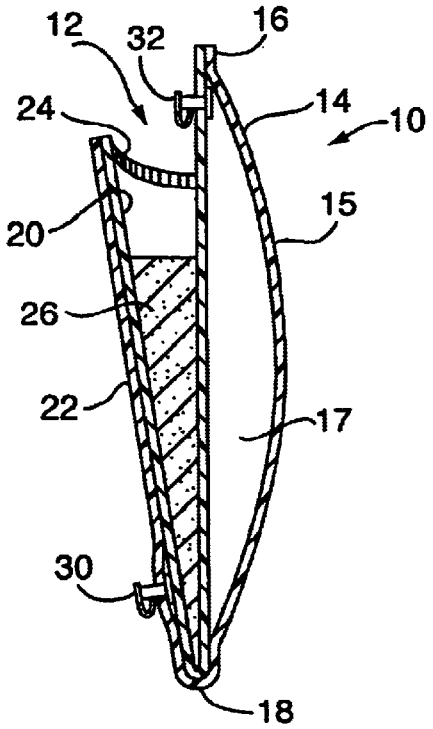
FIG. 3 is a sectional view taken on the line 3—3 of FIG. 2 with the sand pocket filled.

As shown in FIG. 3, both the base sheet 12 and the pocket sheet 14 are folded around the lower margin 18 of the pillow to constitute respectively the sand pocket wall 20 and the water-containing wall 22. The sand pocket wall 20 and the water-containing wall 22 are sealed to the base sheet 12 on its opposite side edges and to each other at 24 along the top margins thereof, leaving an opening for a sand pocket 26.

Figure 4:
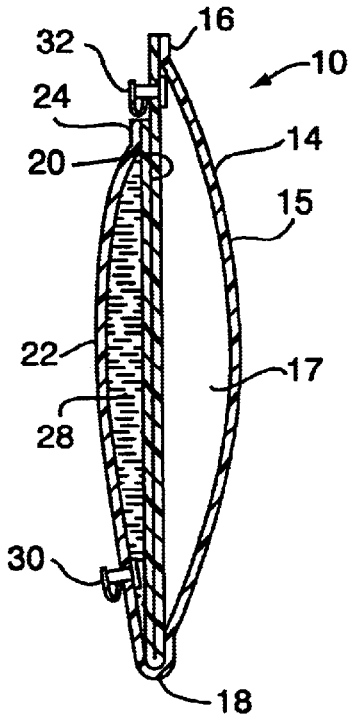
FIG. 4 is similar to FIG. 3 with the water compartment filled.

The sand pocket wall 20 and the water-containing wall 22 define between them a water compartment 28 (FIG. 4). At the lower end of the water compartment 28 is a fill access closed by a removable plug 30. At the upper end of the base sheet 12 communicating with air compartment 17 is an air fill port 32 closed also by a removable plug.

In use, the pillow is blown up by removing the plug and inflating by pump or mouth. Depending on the availability of water and sand, the water compartment 28 or sand pocket 26 is at least partly filled. The weight of the water or sand will anchor the pillow to keep the wind from blowing it away from its desired placement. By suitable dimensioning of the width of base sheet 12 between its side edges, the sand pocket 26 may be alternatively used to slip the inflatable pillow over the back of a chair and hold it in place so that the pillow will serve as a head rest.

While the preferred embodiment of the invention utilizes plastic as the material for the base sheet 12 and pocket sheet 14, which is sealed to the base sheet 12 to form the pillow compartment and the water compartment, other materials for these sheets may also be substituted such as rubberized or plasticized fabric. Also it is not necessary that pocket sheet 14 be a single member as it is indicated in FIGS. 3 and 4. The air confining sheet section 15 and the water containing wall 22 may be separate members rather than part of the same pocket sheet 14 as shown in the modification described below.

MODIFICATION

Figure 5:
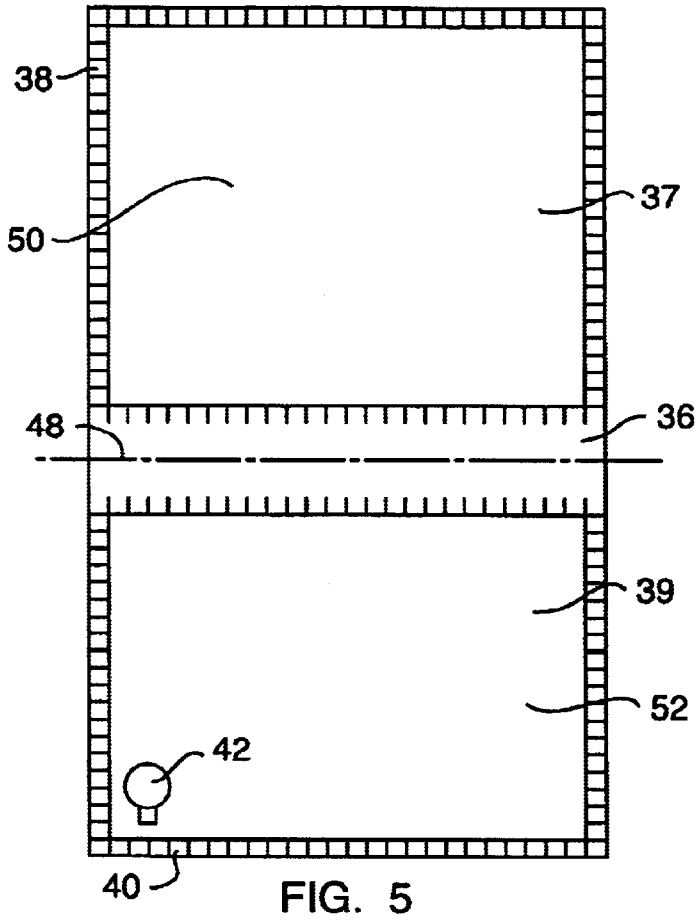
FIG. 5 is a top plan view of a modification of the beach pillow embodying the invention, shown before folding.
Figure 6:
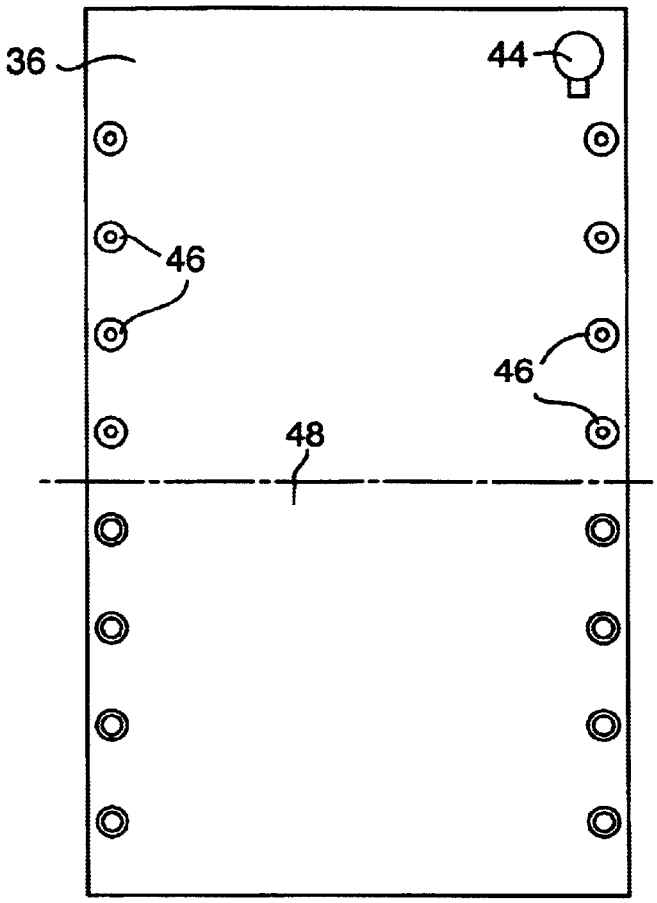
FIG. 6 is a bottom plan view thereof.

A modified form of the invention is shown in FIGS. 5 through 9. FIGS. 5 and 6 show the inflatable pillow assembly before folding. The top plan view of FIG. 5 shows a base sheet 36. A first flexible sheet section 37 is sealed about its periphery, as seen at 38 to the underlying base sheet 36 to form an inflatable air compartment 50 for providing a pillow. A second flexible sheet section 39 is sealed about its periphery to a second portion of the base sheet around its periphery, as at 40 to provide a fillable water compartment 52. A closure valve 42 in sheet 39 communicates with the water compartment.

As seen in the bottom plan view of FIG. 6, an air valve 44 in base sheet 36 is located so that it communicates with the inflatable air compartment. A series of snap fasteners 46 are positioned along the opposite edges of the base sheet. Base sheet 36 is foldable along a fold line 48 extending between the side edges. Also, other fastening devices such as Velcro strips may be used in lieu of the snap fasteners 46 along the edges of the base sheet.

Figure 7:
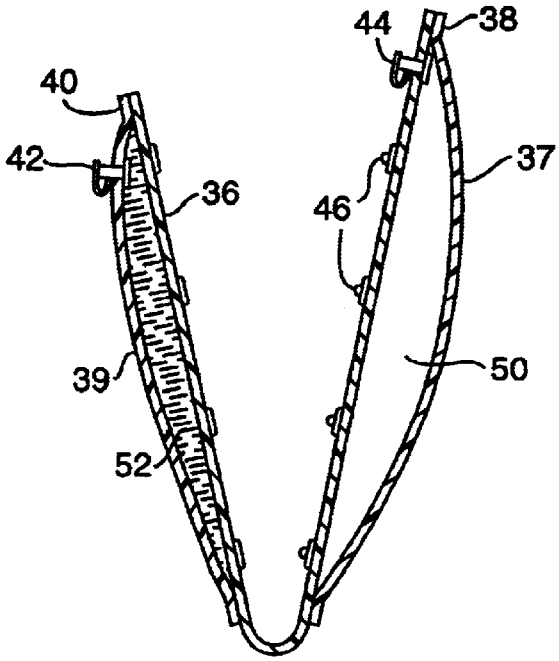
FIG. 7 is a side elevational view taken in cross-section through the center line of the modified beach pillow during folding.
Figure 8:
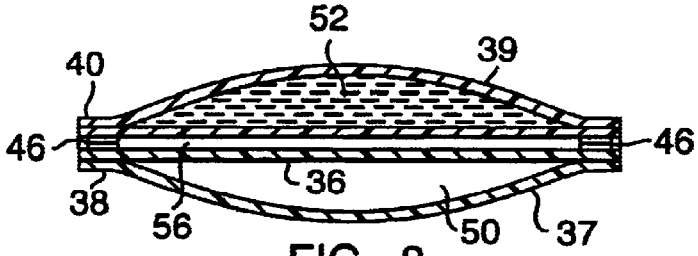
FIG. 8 is a top plan view, taken in cross-section through the center line after folding, with the water compartment filled.
Figure 9:
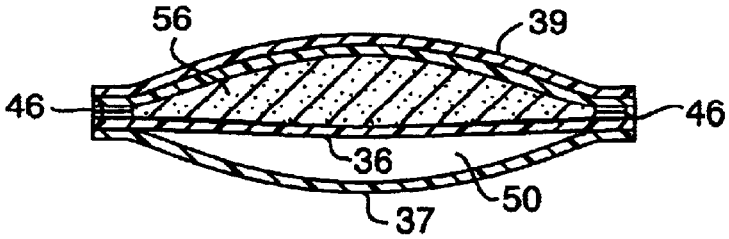
FIG. 9 is the same view as FIG. 8 with the water compartment empty and the sand pocket filled.

Reference to FIG. 7 shows the beach pillow partly inflated using valve 44 to fill the air compartment 50. Closure valve 42 has been used to fill the water compartment 52 for weighting the beach pillow. The snap fasteners 46 are then connected to form a sand pocket 56 (see FIGS. 8 and 9). The water compartment 52 may be partially or completely filled with water as indicated in FIG. 8. Alternatively, as shown in FIG. 9, the water compartment may be drained through closure valve 42 and sand or other weighting material introduced into the open end of the sand pocket 56. By selecting suitable dimensions for the width of the base sheet along fold line 48, sand pocket 56 may alternatively be slipped over the back of a chair to hold the inflatable pillow in place.

While there has been described what is considered the preferred embodiment of the invention and one modification thereof, other modifications will occur to those skilled in the art, and it is desired to secure in the appended claims all such modifications as fall within the spirit and scope of the invention.

What is claimed is:

1. An inflatable weightable beach pillow comprising:

a generally rectangular flexible base sheet having opposite side edges and arranged to be folded about a fold line extending between its side edges;

a first flexible sheet section sealed about its periphery to a first portion of said base sheet on one side of said fold line to define an inflatable air compartment for providing a pillow;

a second flexible sheet section sealed about its periphery to a second portion of said base sheet on the other side of said fold line to provide a fillable water compartment for weighting the beach pillow;

an air valve communicating with the air compartment for inflating and deflating it;

a closure valve communicating with the water compartment for filling and draining it; and said first and second portions of said base sheet defining a pocket having an open end for selectively receiving an alternate weighting material.

2. The beach pillow according to claim 1, wherein the side edges of the base sheet are permanently sealed together on opposite ends of the fold line to provide said pocket.

3. The beach pillow according to claim 1, wherein the side edges of the base sheet include means for temporarily connecting the side edges together on opposite ends of the fold line to provide said pocket.

4. The beach pillow according to claim 1, wherein the side edges of the base sheet are spaced apart from one another a sufficient distance to enable said pocket to slip over the back of a chair to hold the pillow in place.

5. The beach pillow according to claim 1, wherein the first and second flexible sheet sections are part of a single pocket sheet connecting said sheet sections together across said fold line.

6. The beach pillow according to claim 1, wherein the first and second flexible sheet sections are separate sheets of flexible material sealed to said base sheet.

7. An inflatable weightable beach pillow comprising:

a generally rectangular flexible base sheet having opposite side edges, a generally rectangular pocket sheet overlying said base sheet, said base sheet and said pocket sheet being folded together about a fold line extending between said side edges with the base sheet on the inside and sealed together along the side edges to provide a sand pocket;

said pocket sheet including a first flexible sheet section sealed about its periphery to a first portion of said base sheet on one side of said fold line to define an inflatable air compartment for providing a pillow and including a second flexible sheet section sealed about its periphery to a second portion of said base sheet on the other side of said fold line to provide a fillable water compartment for weighting the beach pillow;

an air valve communicating with the air compartment for inflating and deflating it;

a closure valve communicating with the water compartment for filling and draining it; and said sand pocket being dimensioned to fit over the back of a chair to hold the pillow in place when it is not being used as a weighted beach pillow.

* * * * *